US011391036B2

(12) United States Patent
Crozier

(10) Patent No.: US 11,391,036 B2
(45) **Date of Patent: *Jul. 19, 2022**

(54) SHIPPING CONTAINER EXPANSION INSERT

(71) Applicants: Maple Melder Crozier, Abbotsford (CA); Rebox Containers Inc., Victoria (CA)

(72) Inventor: Michael J. Crozier, Abbotsford (CA)

(73) Assignee: Rebox Containers Inc., Victoria (CA)

( * ) Notice: Subject to any disclaimer, the term of this patent is extended or adjusted under 35 U.S.C. 154(b) by 84 days.

This patent is subject to a terminal disclaimer.

(21) Appl. No.: 16/725,088

(22) Filed: Dec. 23, 2019

(65) Prior Publication Data

US 2020/0256050 A1 Aug. 13, 2020

Related U.S. Application Data

(63) Continuation of application No. 15/608,985, filed on May 30, 2017, now Pat. No. 10,519,647.

(60) Provisional application No. 62/345,824, filed on Jun. 5, 2016.

(51) Int. Cl.

| | |
|---|---|
| ***E04B 1/343*** | (2006.01) |
| ***E04B 1/344*** | (2006.01) |
| ***E04B 1/348*** | (2006.01) |
| ***E04H 1/12*** | (2006.01) |

(52) U.S. Cl.

CPC ..... *E04B 1/34357* (2013.01); *E04B 1/3431* (2013.01); *E04B 1/3445* (2013.01); *E04B 1/3483* (2013.01); *E04B 1/34336* (2013.01); *E04B 1/34384* (2013.01); *E04H 1/1205* (2013.01); *E04B 2001/34389* (2013.01); *E04B 2103/06* (2013.01); *E04H 2001/1283* (2013.01)

(58) Field of Classification Search

CPC ..... E04B 1/34357; E04B 1/3483; E04B 1/34384; E04B 1/3445; E04B 1/34336; E04B 2001/34389; E04B 2103/06; E04B 1/3431; E04H 1/1205; E04H 2001/1283

USPC ..... 52/79.5, 79.12, 71

See application file for complete search history.

(56) References Cited

U.S. PATENT DOCUMENTS

| | | | | |
|---|---|---|---|---|
| 2,167,557 | A * | 7/1939 | Stout | B60P 3/34 52/69 |
| 2,329,444 | A ‡ | 9/1943 | Snyder | |
| 3,044,540 | A ‡ | 7/1962 | Hammersley | |
| 3,182,424 | A ‡ | 5/1965 | Betjemann | |
| 3,827,198 | A * | 8/1974 | Geihl | E04B 1/3444 52/69 |
| 4,425,741 | A | 1/1984 | Ronai | |
| 4,742,653 | A | 5/1988 | Napier et al. | |
| 4,854,094 | A ‡ | 8/1989 | Clark | |
| 4,891,919 | A ‡ | 1/1990 | Palibroda | |
| 5,170,901 | A | 12/1992 | Bersani | |
| 5,228,258 | A | 7/1993 | Onoda et al. | |

(Continued)

*Primary Examiner* — James M Ference

(74) *Attorney, Agent, or Firm* — Larson & Anderson, LLC

(57) ABSTRACT

An expansion insert for converting an ISO shipping container into a housing unit is provided, the insert having a compacted form reversibly convertible to a expanded form. The insert has a frame assembly torsionally hinged to a roof assembly and a floor assembly. Two pivot walls and a sidewall are also built into the insert. The insert may be compacted for shipping, expanded after insertion into an ISO container, and compacted again on the ISO container.

9 Claims, 9 Drawing Sheets

(56) References Cited

U.S. PATENT DOCUMENTS 5,345,730 A 9/1994 Jurgensen
5,403,055 A ‡ 4/1995 Allison
5,761,854 A * 6/1998 Johnson ..... B60P 3/34 135/116
5,815,988 A ‡ 10/1998 Molina
5,966,956 A ‡ 10/1999 Morris et al.
6,345,471 B1 * 2/2002 Gyllenhammar ..... E04B 1/3444 296/169
7,290,372 B2 11/2007 Aust et al.
7,418,802 B2 ‡ 9/2008 Sarine et al.
7,828,367 B2 * 11/2010 Hickam ..... B60P 3/34 296/156
7,882,659 B2 * 2/2011 Gyory ..... E04B 1/3444 52/79.5
7,926,226 B2 ‡ 4/2011 Pope
8,020,347 B2 ‡ 9/2011 Mower et al.
8,156,691 B2 ‡ 4/2012 Dickson et al.
8,166,715 B2 ‡ 5/2012 De Azambuja
8,347,560 B2 * 1/2013 Gyory ..... E04B 1/3483 52/79.5
8,371,091 B2 ‡ 2/2013 Graf
8,613,166 B2 * 12/2013 Smith ..... E04B 1/3445 52/66
8,622,066 B2 ‡ 1/2014 Dolsby et al.
8,650,806 B1 ‡ 2/2014 Condie
8,978,318 B2 3/2015 Klein
9,080,326 B2 * 7/2015 Johnson ..... B65D 90/143
9,085,890 B2 * 7/2015 Strickland ..... E04B 1/34357
2006/0248812 A1 11/2006 Pruitt et al.
2007/0107320 A1 ‡ 5/2007 Brochu et al.
2007/0209294 A1 9/2007 Harvey
2009/0217600 A1 9/2009 De Azambuja
2009/0272046 A1 11/2009 Letscher, III et al.
2010/0043308 A1 2/2010 Keeble
2011/0214362 A1 9/2011 Huang
2012/0181851 A1 ‡ 7/2012 Bates
2012/0261407 A1 ‡ 10/2012 Cross et al.
2013/0305626 A1 11/2013 Strickland et al.
2014/0033619 A1 2/2014 Merchant
2014/0144088 A1 5/2014 Heger
2014/0311051 A1 10/2014 Fagan
2015/0218794 A1 8/2015 Martyn
2015/0315776 A1 11/2015 Duncan
2017/0030071 A1 * 2/2017 Sorensen ..... E04B 1/3442
2017/0051497 A1 2/2017 Kolbe et al.
2017/0222598 A1 8/2017 Campbell
2017/0314255 A1 11/2017 Klein
2017/0335561 A1 11/2017 Wickramasekera

* cited by examiner
‡ imported from a related application

SHIPPING CONTAINER EXPANSION INSERT

This application takes priority from U.S. provisional patent application 62/345,824 filed Jun. 5, 2016.

BACKGROUND OF THE INVENTION

Expandable shipping containers have been utilized for several decades by militaries of the world. The ability to ship cargo in the shipping configuration of the ISO (International Standards Organization) container and subsequently, upon arrival, repurpose it as a shelter, either empty or preconfigured, has often been considered advantageous to many government agencies. The term "Hard Wall Expandable ISO" is commonly used to refer to the type of ISO container that expands by means of sliding or pivoting outward panels of which form the floors, walls and roofs of the expanded space. Typical containers of this type are shown, for example, in the following United States patent documents: U.S. Pat. No. 8,650,806 by Condie; United States Publication No. 20120151851 by Cantin et al.; United States Publication No. 20120261407 by Cross et al.; United States Publication No 20070107321 by Sarine et al.; and U.S. Pat. No. 8,622,066 by Dolsby et al.

Hard wall expandable ISO containers are custom-built containers that require built-in-place expansion assemblies. They are large and expensive to ship. They also require skilled labor to perform extensive custom metal weldments that create the expansion.

Although such expansion systems for shipping containers have achieved considerable popularity among militaries and other well-financed government agencies, there has been a continuing need to improve the technology for other markets. One example would be emergency housing funded by donations, in locations where regular ISO containers are available for conversion.

SUMMARY OF THE INVENTION

In accordance with one embodiment of the invention, there are provided an expansion insert for converting an ISO shipping container into a housing unit, the insert having a compacted form and a expanded form, which two forms are reversibly convertible. In embodiments, the insert includes a frame assembly torsionally hinged to each of a roof assembly and a floor assembly. In embodiments, the insert further includes two pivot wall assemblies. In embodiments, the insert includes a sidewall assembly hinged to the floor assembly.

In accordance with embodiments of the invention, an expansion insert for converting an ISO shipping container into a housing unit is provided, in which the frame assembly comprises a rectangular frame having a roof edge, a floor edge, a frame left hand pivot wall, and a frame right hand pivot wall; and in which the roof assembly is torsionally hinged to the roof edge, and the floor assembly is torsionally hinged to the floor edge; and wherein a side wall assembly is hinged to the floor assembly; and wherein there is a left hand pivot wall assembly rotatable in relation to the frame left hand pivot wall; and there is a right hand pivot wall is rotatable in relation to the frame right hand pivot wall.

In embodiments, the insert further includes a spring diagonally connected to the frame left pivot wall edge and the roof assembly, and a spring diagonally connected to the frame right pivot wall edge and the roof assembly. In embodiments, the spring is a gas piston spring.

In embodiments, panel latches secure the floor, side wall, and roof panels in an expanded conformation of the insert. In embodiments, the panel latches maintain the insert in a compact conformation.

In embodiments, the assemblies are connected to the frame assembly to open out from the frame on one side, to form a three-walled extension with a weather resistant roof and floor. In accordance with embodiments of the invention, there is provided a kit for expanding the living space afforded by an ISO container, comprising the insert in compacted form, and instructions for assembly. In embodiments of the invention, the insert can be expanded without heavy machinery once it is inserted into an ISO container.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

A compactible, shippable insert for expanding ISO containers into shelters is provided. When deployed and installed, the insert is as shown as in FIG. 1 at 1.

If two Inserts are installed in place of the standard ISO container corrugated steel side walls, this expansion creates additional shelter space increasing the basic floor area of the ISO container from 139 square feet to 373 square feet.

When deployed/installed, the insert 1 is attached to a standard ISO shipping container 100 by means of fasteners which connect the frame assembly 2 of the Insert to the structural frame of the ISO container in such a way that the external bounds of the ISO container are not violated. The ISO container retains its CSC certification but becomes an enlarged shelter.

Figure 2:
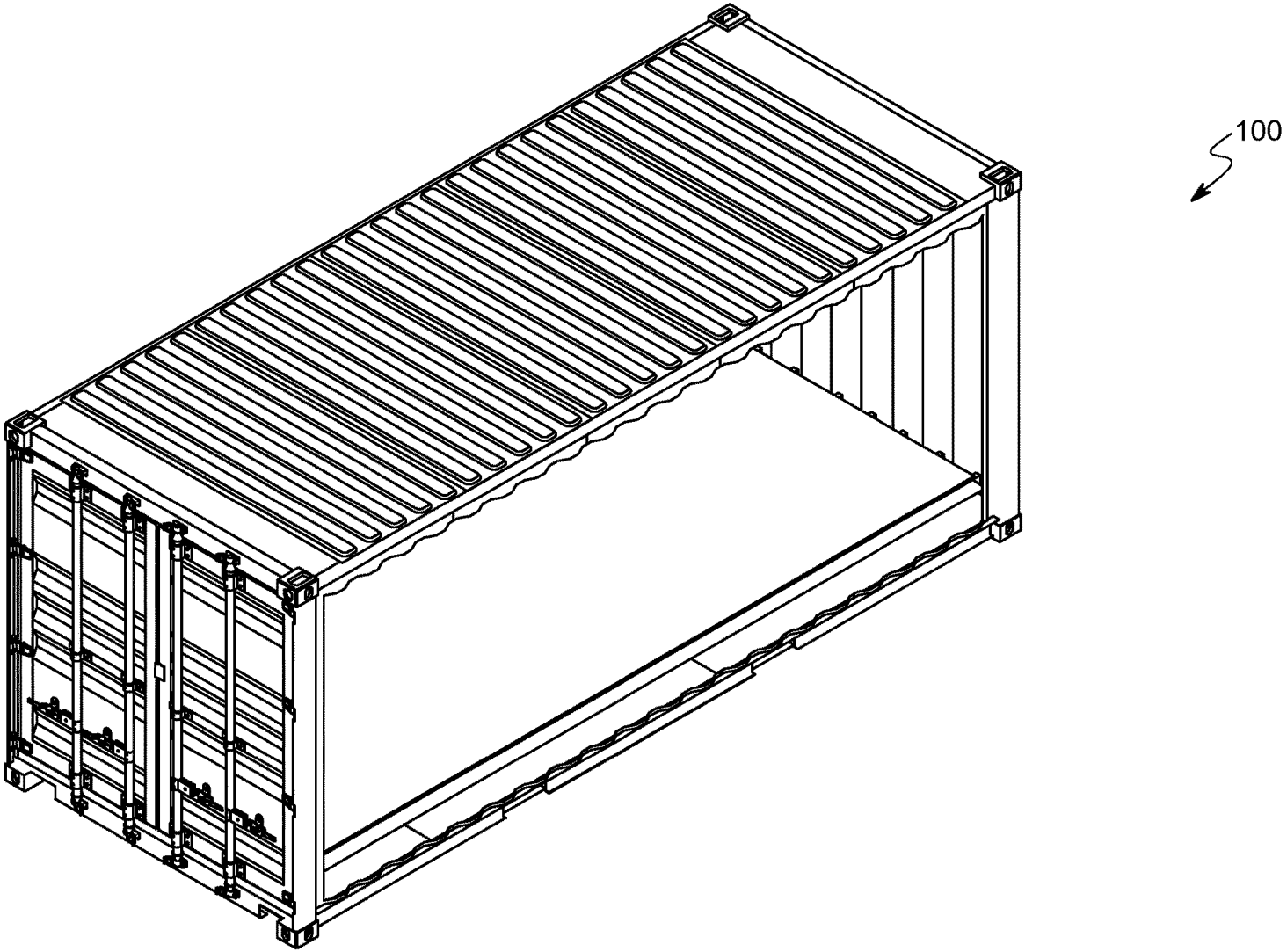
FIG. 2 shows an ISO container with one side cut out with one side removed in order to facilitate the addition of an insert of the invention.
Figure 4A:
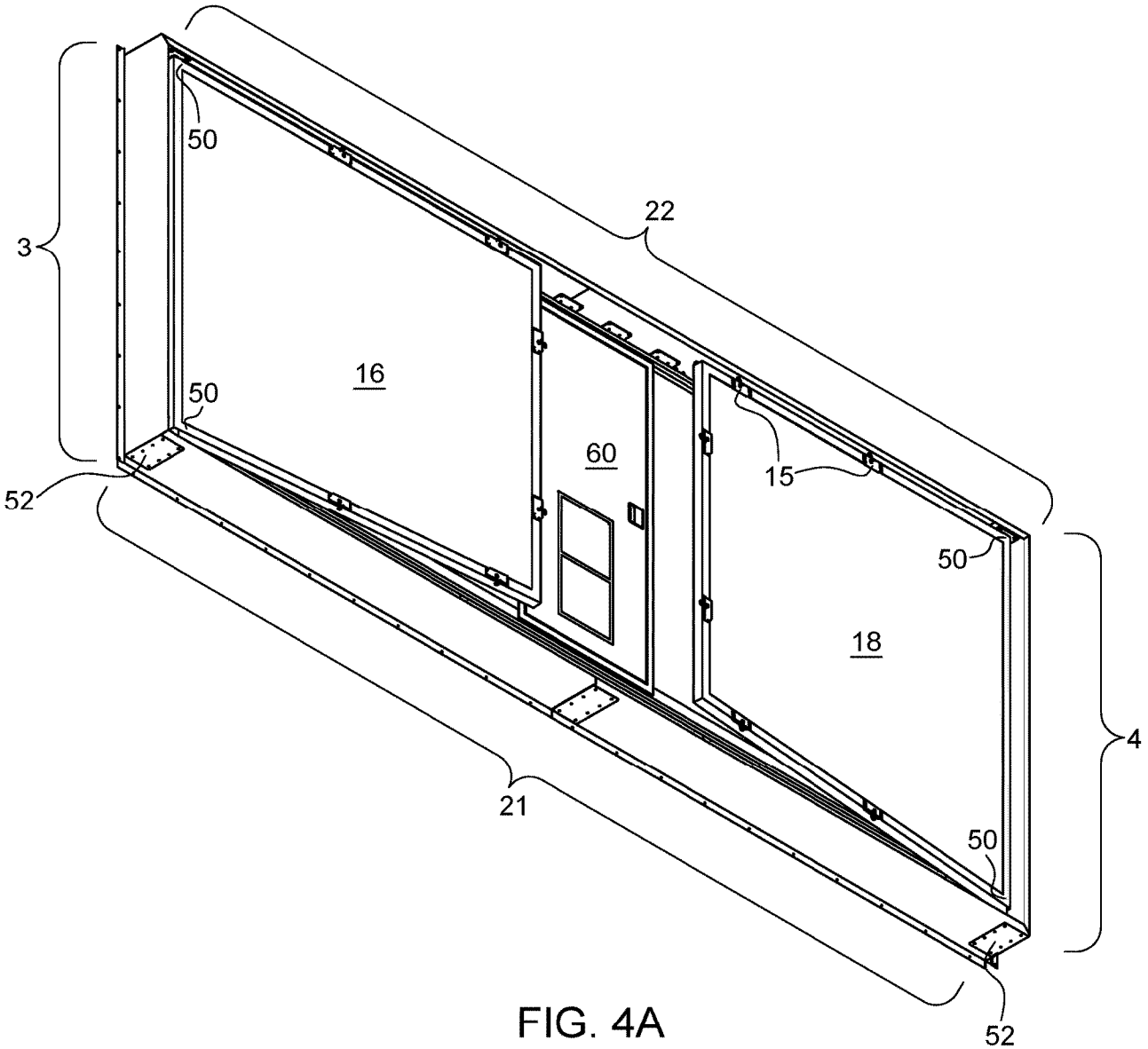
FIG. 4*a* is a perspective view of the front of an insert from the upper right, showing an insert of the invention in semi-compacted configuration.
Figure 4B:
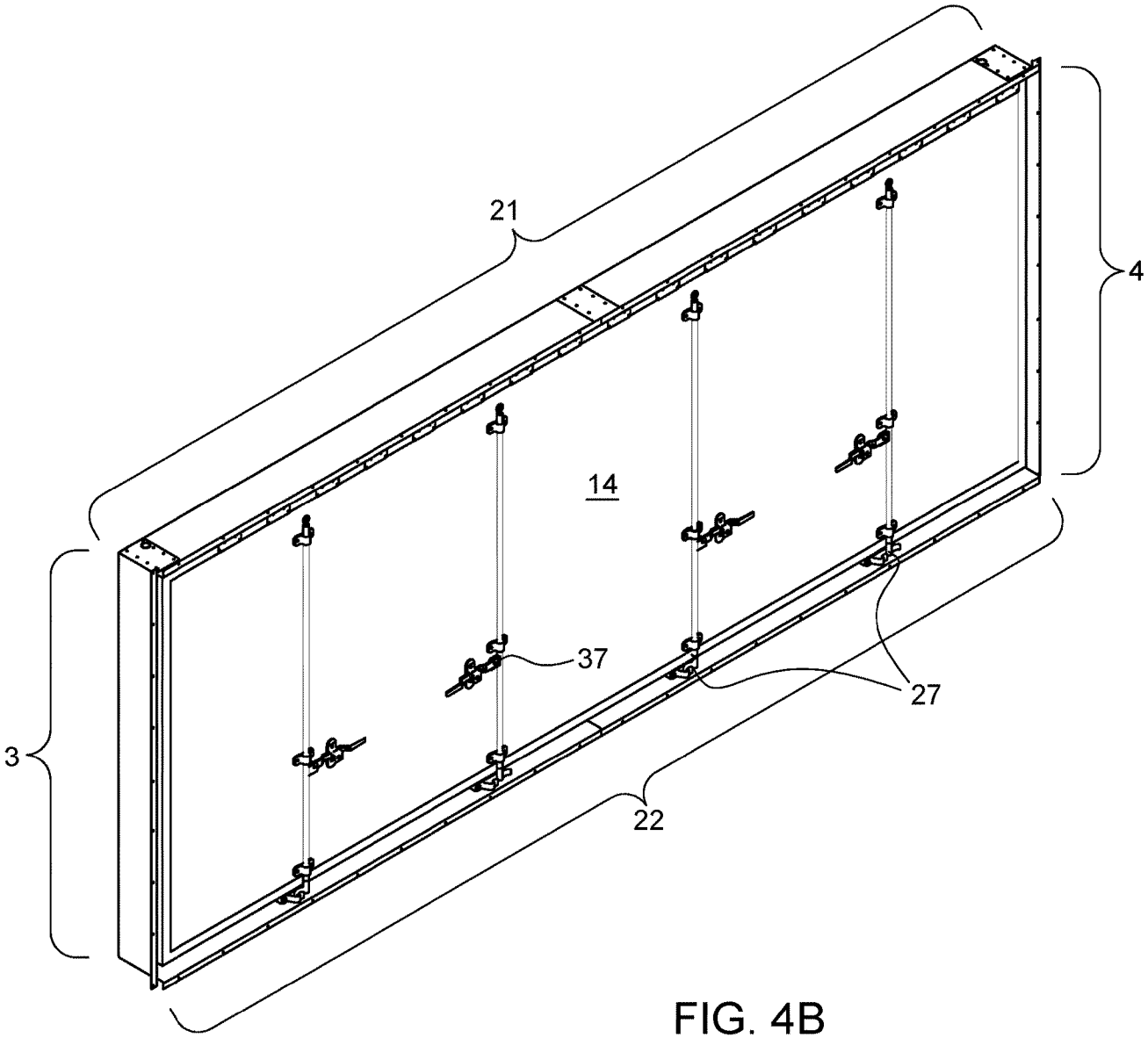
FIG. 4*b* is a perspective view from of the rear of a compacted Insert of the invention with the roof assembly in view.

The insert 1 will ship as a one piece preassembled kit. A compacted insert suitable for transporting is shown in FIG. 4*b*. The customer will cut out one side of the shipping container, creating the modified ISO container as shown in FIG. 2, and then position the Insert using a crane or forklift.

Figure 3:
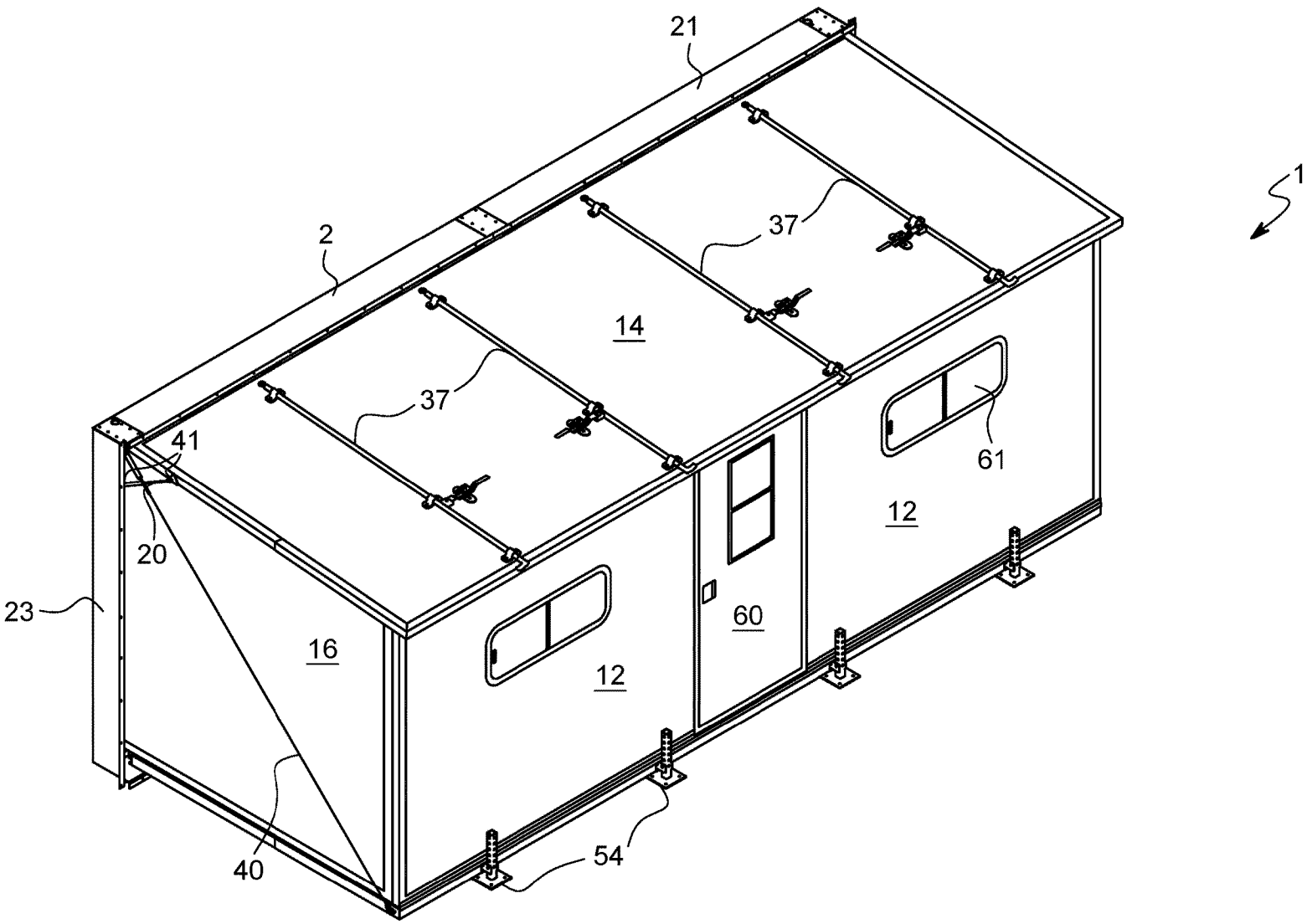
FIG. 3 shows a perspective view of an insert of the invention from the upper left.

Insert 1 is shown in isolation in FIG. 3, not installed in an ISO container, in order to show inside details. Frame assembly 2 is engaged to:

a left pivot wall assembly 8 via a pivot wall assembly hinge 13;

a right pivot wall assembly 9 via another pivot wall assembly hinge 13;

a roof panel 7 by roof torsion spring 10; and a floor panel 3 via floor torsion spring 11.

Components

Container 100 is shown in FIG. 2, already prepared for Insert placement. In this specification, container 100 refers to a standard ISO shipping container which conforms to the Convention for Safe Containers (CSC) specifications both in structural strength and dimensions. These container come in a range of sizes, including 20, 24, 28, 30, 40 and 53 feet long, but the ICC (20L×8.0W×8.5'H) model is a preferred size for the insert.

"Panels" are, in some embodiments, composite materials combined to create a wall with a combination of desired qualities including lightness, strength, and thermal insulation. In embodiments of the invention, "panels" or "composite panels" are fiberglass/polystyrene. In these embodiments, the panels are made like a sandwich, with fiberglass sheets on both surfaces of a core layer of polystyrene. In preferred embodiments of the floor panel 3 (FIG. 5) the core layer is honeycomb plastic for greater strength. In other embodiments of the invention, the panels are layered aluminum (Al)/polyurethane (PU)/expandable polystyrene (EPS). These panels form the bulk of the five planes of the insert, and include: sidewall panel 6, floor panel, roof panel 7, and pivot wall panels left 8 and right 9 (as seen in FIG. 4*a*).

When assembled into the complete insert 1 of the invention, with connectors, hinges, springs, ball brackets, support cable, camlocks and connectors, each panel is called "panel assembly" with whatever preface is appropriate.

The term camlocks 37 as used in the specification are fastening mechanisms that use a cam or tab that is turned to engage a catch or slot, basically a rotary bar locking mechanism. In embodiments of the invention, and as shown in FIG. 3, additional camlocks 37 are used on sidewall assembly 12 to provide anti-racking strength to the ISO container side by structurally linking the top side rail of container 100 to the bottom side rail of the container 100. Without the additional strength these camlocks 37 provide, adding the insert would severely weaken the ISO container 100 structure. Another important effect of the insert camlocks 37 is to stiffen the roof panel 7 when the insert 1 is deployed, to resist environmental and imposed live loads. The camlocks 37 are fastened securely to the roof panel, making a much stronger composite panel 7.

Figure 7:
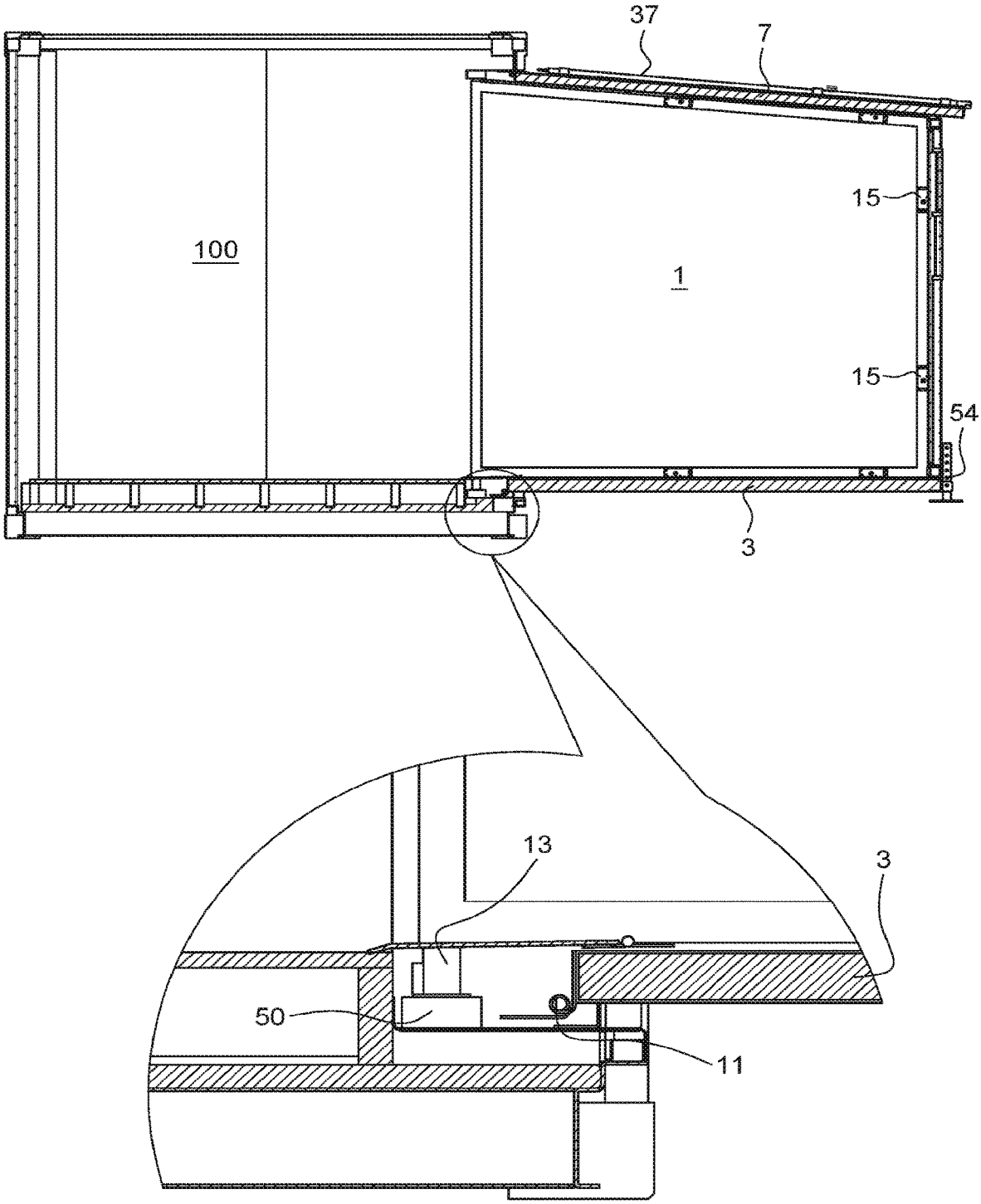
FIG. 7 is a cross sectional view of the insert, with an expanded view of the roof assembly to frame assembly connection and hinge.

Hinges as used in the specification mean simple hinges or pivots. Torsion springs or torsional hinges are constructed of a flexible material that works by storing mechanical energy when it is twisted. Roof torsion spring 10 is shown in cross section in FIG. 8, and floor torsion spring 11 is shown in FIG. 7. Pivot wall assembly (left/right) hinge 13 is, in some embodiments, a pole pivoting between two anchor blocks 50 at the roof and floor assemblies, and not a torsional spring. The pole is aluminium, or in preferred embodiments, plastic.

Figure 1:
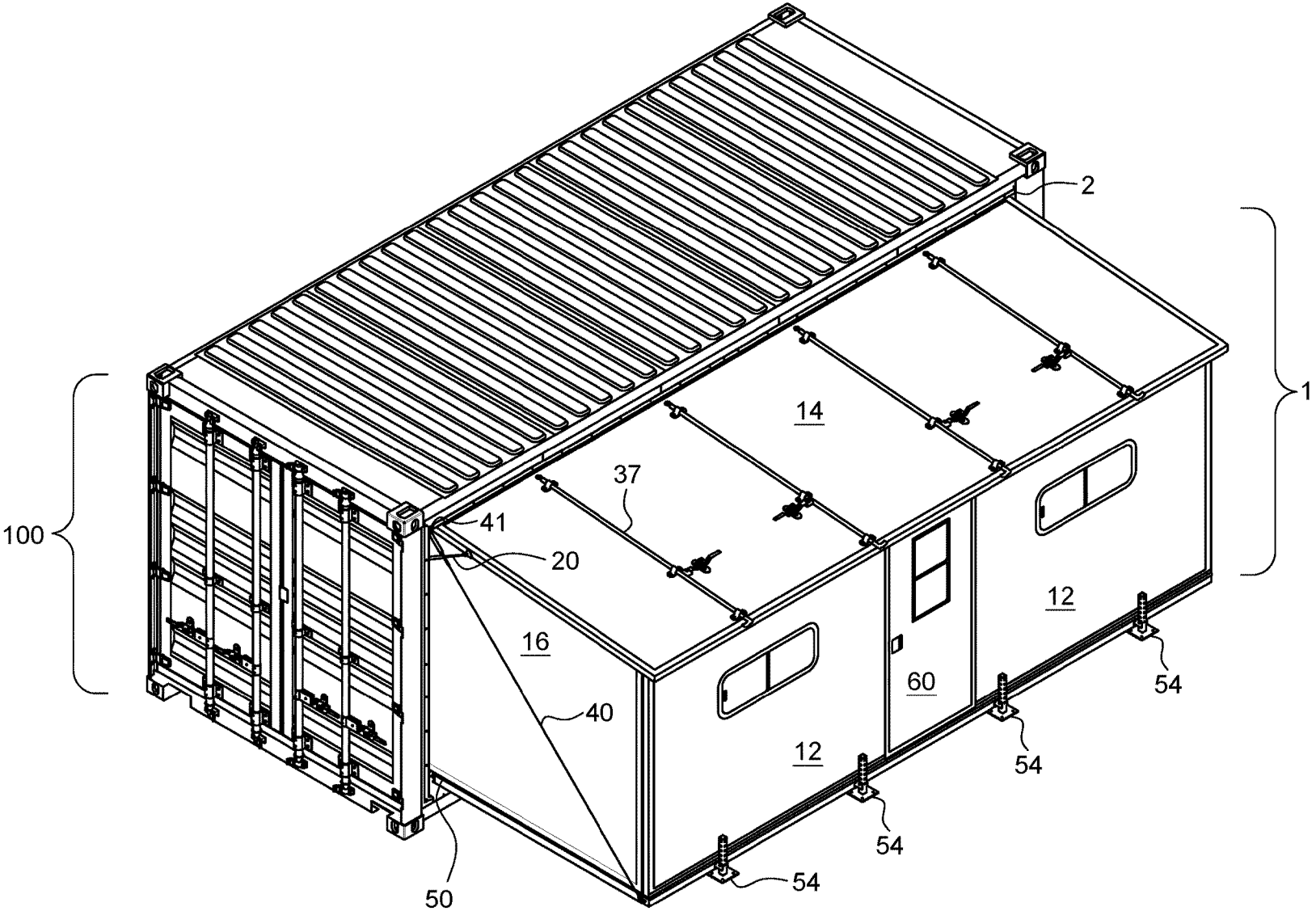
FIG. 1 shows a perspective view from the upper left of the insert with the hinged panels in deployed configuration, set inside an ISO container.

Gas Piston Springs 20, as seen in FIG. 1, are used in two ways for supporting the roof: a) while the torsion spring 10 in the roof assembly 14 assists the installer in deploying the Insert, reducing the required force he or she has to exert to raise the roof to about 50 pounds of force at the apex of rotation (90 degrees). Alone, the torsion spring 10 would not hold the roof at 90 degrees, but if it were made any "stronger", the roof would rise dangerously fast from vertical and require something to prevent over-rotation. The gas spring 20 solved this problem. Gas spring 20 takes over the lift as the roof approaches horizontal, and provides a stop at the horizontal position.

In embodiments of the invention, the gas piston spring 20, the frame assembly 2, and the support cable assembly 40 are composed of steel.

In some embodiments, the side panel 6 of the Insert 1 has glass or plastic sliding windows, and a locking access door. In other embodiments, there are also custom ports which allow for connection of power, water and other utilities.

In embodiments, the installed Insert 1 retains the ISO envelope for CSC compliance and is approved for all forms of intermodal transportation.

Kit Manufacture

The frame assembly 2 is manufactured first, and forms the basis for the rest of the insert structure. The frame assembly 2 is rectangular, as best shown in FIG. 3, and shaped to fit within an ISO container along the elongated side of that container. In some embodiments, the frame assembly 2 comprises lightweight sheet metal formed into a "Z" shape, and connected by interlocking flanges into a rectangular enclosure. To form the "Z" shape, a rectangular piece of sheet metal is folded in a press brake. The vertical pieces have additional folds at the ends which wrap around the horizontal pieces and are connected with rivets to form 90 degree corners.

Figure 8:
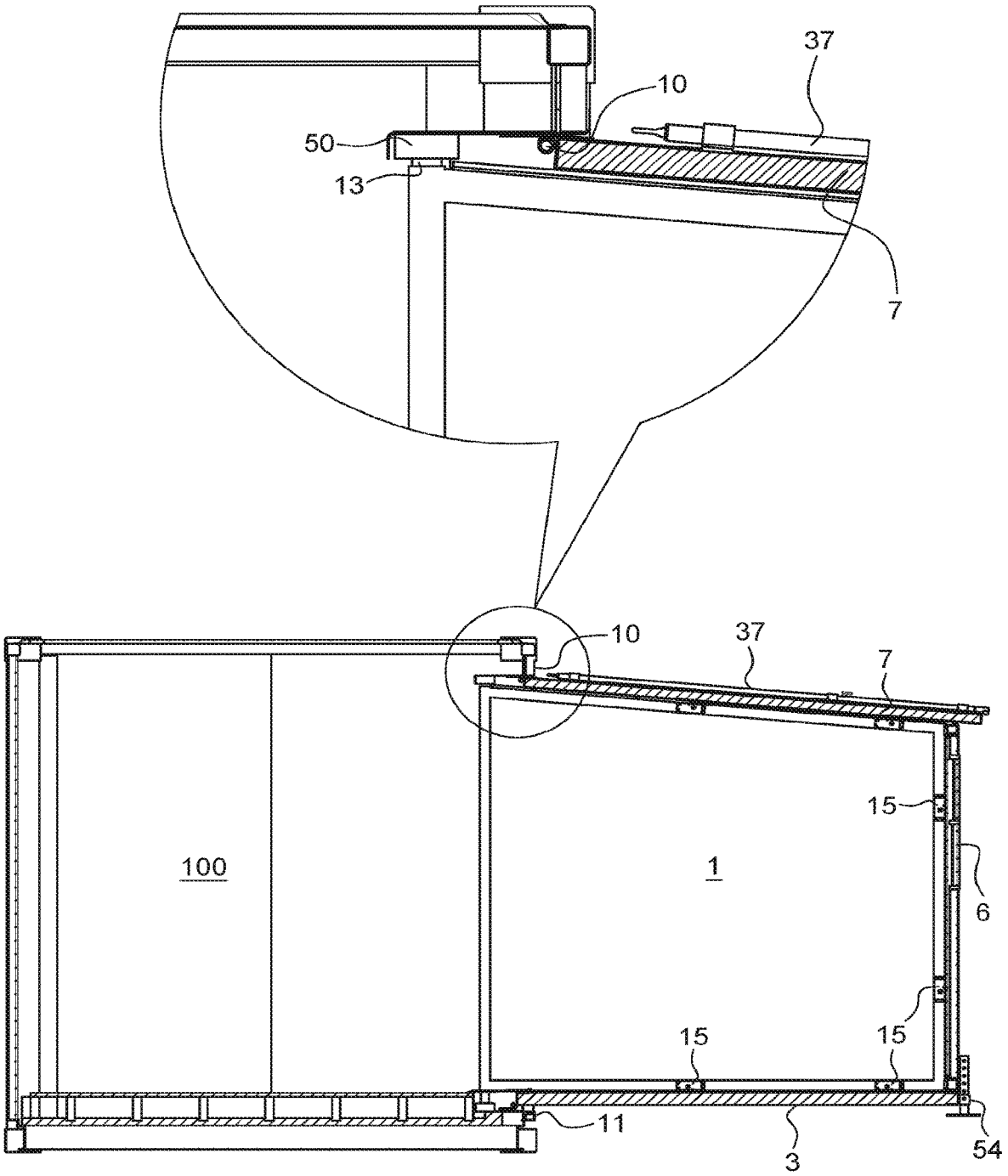
FIG. 8 is a cross sectional view of the insert, with an expanded view of the floor assembly to frame assembly connection and hinge.

The roof panel 7 is mounted to the inside face of the frame edge 21 by means of an attached torsion hinge 10. FIG. 8 shows the hinge 10 in cross section. The roof torsion spring 10 is pre-mounted to the roof panel 7 with cap screws and captive nuts, and fastened to the underside of the frame roof edge 21 with cap screws and captive nuts.

At the inner edge of the frame floor edge 22, cam-lock keepers 27, which in some embodiments are cast steel, are mounted with cap screws and captive nuts pre-mounted to the frame floor edge 22.

The roof panels are also connected to the frame floor edge 22 (for installation and transport) by means of four anti-racking camlocks 37 which allow the compacted insert 1 to remain stable in a fixed, rectangular geometry as best seen in FIG. 4B. The floor panel 3 is connected to the inside face of frame floor edge 22 via a torsion hinge 11. The floor panel 3 is also pre-attached by means of a continuous hinge along its outer edge to the inside face of the frame floor edge 22. FIG. 9 shows the floor torsion hinge 11 in cross section, showing its location with respect to the surrounding panel assembly structures. The final two walls are the right and left hand pivot walls 16 and 18, which are allowed to rotate in low-friction plastic blocks secured to the frame top and bottom of frame assembly 2 at frame, left hand pivot wall 23 and frame, right hand pivot wall 24, respectively. The range of rotation only allows pivoting out from the inside left and right sides of the inner edges of the frame assembly 2 to a 90 degree angle. The floor panel 3 and roof panel 7 must have sufficient strength to carry live loads as determined by applicable building codes. At the same time, panels 3 and 7 must be light enough to enable one person to expand or collapse the insert assembly 1 solely with assistance from roof torsion hinge 10, and gas springs 20 on the right and left upper corner of right hand pivot wall 16 and left hand pivot wall 18 nearest the ISO container 100.

The floor torsion hinge 11 is mounted to the floor panel 3, with cap screws and captive nuts, then fastened to frame floor edge 22 with cap screws and captive nuts pre-mounted in the frame assembly 2. A continuous side wall assembly hinge 13 (plastic in preferred embodiments, aluminum in other embodiments). is mounted with rivets (aluminum in some embodiments) to the rectangular side panel 6, and the other leaf of the pivot wall hinge 13 is fastened with rivets to the floor panel 3 to create a connection between side wall assembly 12 and floor assembly 4, as shown best in FIG. 5. In some embodiments, the side wall assembly 12 includes a flush-mounted, lockable exterior door 60. In other embodiments, a framed sliding window 61 is also present. In embodiments, the window frame is composed of aluminum which clamps to the side wall panel which the glass is tempered or polycarbonate to resist breakage during transport.

The left 8 and right 9 pivot-wall panels are pre-mounted, in some embodiments, to aluminum pipes 13, as illustrated in FIG. 7 and FIG. 8, to which are fitted low friction ultra-high-molecular-weight polyethylene (UHMW) anchor blocks 50, whose location is indicated in FIG. 4A and which are shown in profile in FIG. 7 and FIG. 8. The anchor blocks 50 are mounted to the frame roof edge 21 and frame floor edge 22 with cap screws and captive nuts.

Figure 5:
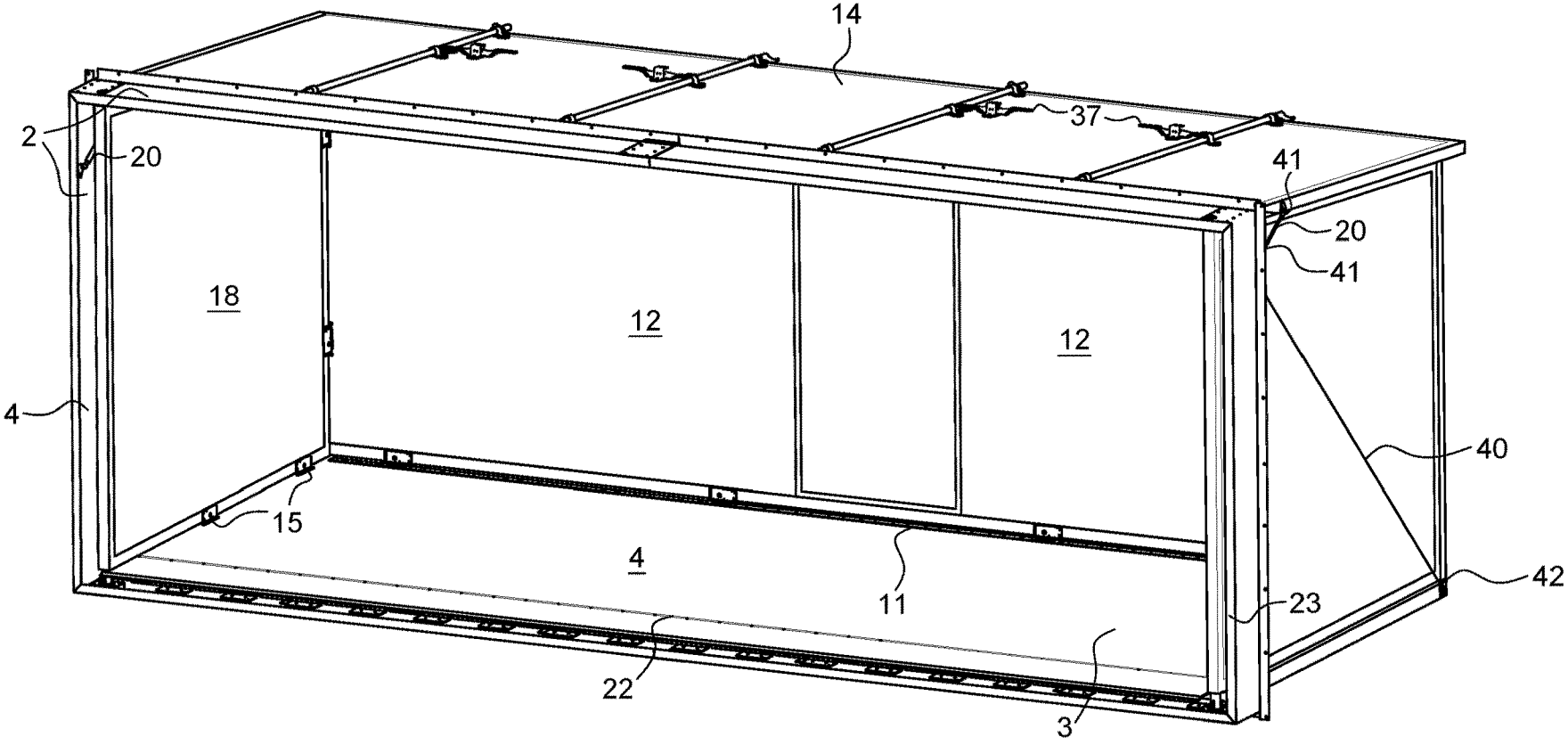
FIG. 5 is a perspective view of an insert fully deployed, but shown without the ISO container to show the interior of the insert.

In embodiments of the invention, a pre-loaded gas spring 20 is mounted, one for each pivot wall, with ball joint ends connected to ball brackets 41, which are situated as shown in FIG. 3 and FIG. 5, and connected to frame, and roof panel. The ball bracket 41 is pre-mounted on the sides of the frame and roof panel, in some embodiments, cap screws and captive nuts.

Support cable assemblies 40 have eyes swaged onto each end. These attach to the floor assembly 4 by means of a ball bracket 41 assembly pre-attached to the floor panel 3 with cap screws and captive nuts. In preferred embodiments of the invention, the ball bracket 41 assembly is ⅜ inch thick. In other embodiments, it is ½ inch thick.

In a similar fashion, and as shown in FIG. 1, the upper ends of the support cable assembly 40 attach to the frame assembly 2 via another ball bracket 41 assembly, in some embodiments, or via a reinforced or heavier region of frame assembly 2. If a ball bracket is used, in some embodiments it is attached to frame assembly 2 via cap screws and captive nuts pre-mounted thereto.

The left 8 and right 9 pivot wall panels contain, along their connecting edges, recessed, male panel atchels. The side wall panel 6 also contains recessed, male panel latches along its roof-assembly 14 oriented edge. At joining surfaces in corresponding locations, the roof panel 7 and floor panel 3, possess recessed, female panel latch receptacles. The panel latches are engaged into a locked position, in some embodiments, by use of a hex key which rotates the hook to engage a recessed restraint bar.

Deployment

As shown in FIGS. 4A and 4B, the insert is in a compacted state before installation. When it is time to expand the insert, each panel pivots into a deployed position and interlocks by means of panel latches 15 to adjacent panels.

The insert 1 is hoisted into the ISO container 100 side, whose one wall has been cut away. The insert frame assembly 2 is secured to the ISO containers by drilling through pre-cut holes in the frame, then inserting and pneumatically engaging high-strength rivets (sometimes referred to as monobolts) at maximum 12" on-centre.

Figure 6:
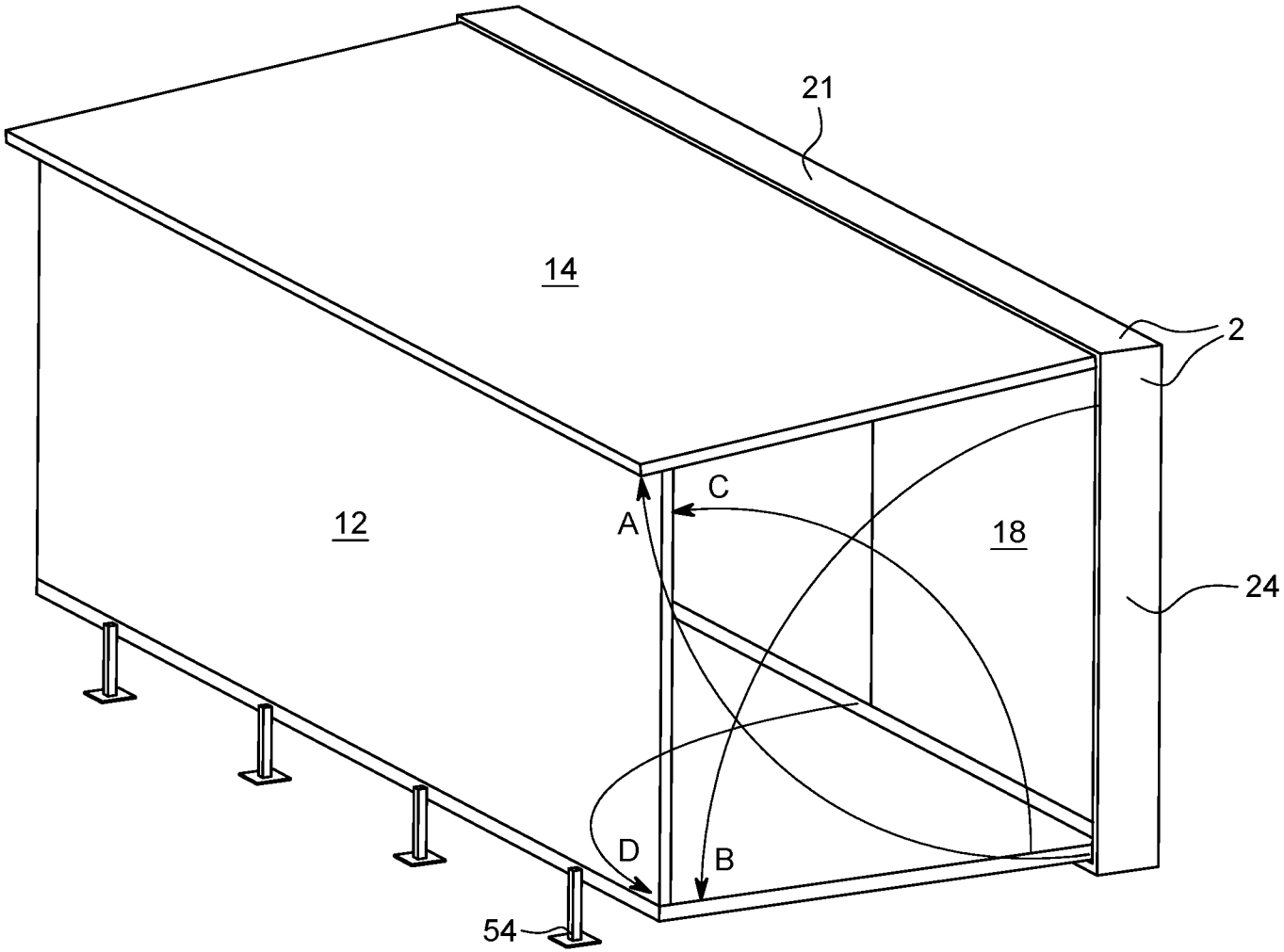
FIG. 6 is a simplified sketch of a perspective view of the insert as might appear in instructions, showing the deployment steps and angles of deployment as a series (A, B, C, D) of directional arrows.

The next step is to expand the insert. Referring to FIG. 6, roof assembly 14 is lifted up and out (A), then floor assembly 4 is lowered (B), then sidewall assembly 12 is then erected (C). Pivot walls are unfolded outward (D). Finally, the installer can pull down on the roof using a built-in handle and mate the roof at 85 degrees from the vertical with the sidewall 12.

In embodiments, the Insert 1 deployed creates an additional 126 square feet of floor area. In embodiments, the interior space available in an Insert-modified ISO container provides 5'-9" open width, even when the Insert 1 walls are compacted, leaving room for permanent installation of furnishings, equipment and appliances in the core. When compacted, each Insert 1 requires only 10.5" of interior space in the ISO container.

Shelter security is preserved during storage or transportation.

In embodiments of the invention, insert installation in an 8'-6" high×20' or 40' long ISO shipping container is simple. After installation, each Insert 1 is deployable by one person in less than 30 minutes using no special tools. Each kit according to embodiments of the invention provides everything needed for the conversion of one side of the ISO container with one side cut out of the container sidewall.

The engineered construction of the Insert 1, and quick-connection of the panel latches 15, provides rapid deployment and pack-up. The positive connection of the roof panel 7 with the panel camlocks 37 mounted to the roof panel 7 with cap screws and captive nuts pre-mounted in the panel face, creates a unified, reinforced structure able to withstand high winds and heavy snow loading.

The floor assembly 4 below and supporting deployed side wall assembly 12, must be supported by means of leveling supports to keep the shelter floor level with the inner frame assembly 20 resting in the ISO container. An embodiment of such a leveler is shown in FIG. 3 and FIG. 6 at 54. When lowered, the insert 1 floor panel 3 sits flush with a built-up false floor that is installed in some embodiments. The space under the false floor doubles as a service chase.

To accommodate the leveler 54, floor assembly 4 has mounting brackets pre-attached to is its outward facing edge, and levelers or supports are supported in the frames and secured with pins or the like.

The Insert according to embodiments of the invention is a modular pre-assembled ISO container expansion kit. The kit format simplifies recertification of the expanding container. A compactible kit also has improved distribution and shipping logistics due to the ability to stack Inserts on a flat deck truck or trailer, or in a standard ISO container for transport. The many physical advantages combine to reduce cost, which allows the entry of ISO storage container expansion into non-military markets.

While specific embodiments of the invention have been described and illustrated, such embodiments should be considered illustrative of the invention only and not as limiting the invention as construed in accordance with the accompanying claims.

The invention claimed is:

1. An expansion insert having a plurality of exterior walls, the exterior walls consisting of one or more side walls, a roof wall disposed within a roof assembly, a floor wall disposed within a floor assembly, the expansion insert further comprising a four-sided frame torsionally hinged to each of the roof assembly and the floor assembly, wherein the four-sided frame is sized and shaped for attachment within an opening of an ISO shipping container, wherein:

the expansion insert is sized and shaped for expanding an enclosed space of the ISO shipping container and converting the ISO shipping container into a shelter when attached to the ISO shipping container, the expansion insert has a compacted form and an expanded form, wherein the compacted and expanded forms are reversibly convertible, when the expansion insert is in the expanded form the expansion insert takes a shape of a plural-sided structure, wherein the one or more sidewalls, the roof wall, and the floor wall make up all but one side of the plural-sided structure, and the all but one side of the plural-sided structure has no wall and is open to the shelter space of the ISO shipping container when attached to the ISO shipping container, and when the expansion insert is in the compacted form the exterior walls are enclosed within the rectangular frame.

2. The expansion insert of claim 1 wherein one or more of the sidewalls are disposed within pivot sidewall assemblies.

3. The expansion insert of claim 2, wherein all sidewalls are disposed within pivot sidewall assemblies hinged to the floor assembly.

4. The expansion insert of claim 3, wherein the four-sided frame comprises a rectangular frame having a roof edge, a floor edge, a frame left hand pivot wall, and a frame right hand pivot wall; and wherein the two pivot wall assemblies comprise a left hand pivot wall assembly that is rotatable in relation to the frame left hand pivot wall and a right hand pivot wall that is rotatable in relation to the frame right hand pivot wall.

5. The expansion insert of claim 4 further comprising a spring means diagonally connected to the frame left pivot wall edge and the roof assembly, and a spring means diagonally connected to the frame right pivot wall edge and the roof assembly.

6. The expansion insert of claim 5, wherein the spring means is a gas piston spring which aids the torsion spring in elevating said roof assembly toward a horizontal position.

7. A kit for expanding the enclosed space of an ISO shipping container, comprising the expansion insert of claim 1 in the compacted form, and instructions for assembly.

8. The kit for expanding the enclosed space of an ISO shipping container of claim 7, further comprising an ISO shipping container and instructions for attaching the expansion insert to the ISO shipping container.

9. A shelter comprising the expansion insert of claim 1 attached to an ISO shipping container so as to expand the enclosed space of the ISO shipping container.

* * * * *